US006975825B2

(12) United States Patent
Sakamaki et al.

(10) Patent No.: US 6,975,825 B2
(45) Date of Patent: Dec. 13, 2005

(54) DEVELOPING APPARATUS INCLUDING FIRST AND SECOND MAGNETS WITH POLES ARRANGED TO SUPPLY DEVELOPER WITHOUT CONTAMINATION

(75) Inventors: Tomoyuki Sakamaki, Toride (JP); Masaru Hibino, Ushiku (JP); Fumitake Hirobe, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/406,458

(22) Filed: Apr. 4, 2003

(65) Prior Publication Data

US 2004/0037594 A1 Feb. 26, 2004

Related U.S. Application Data

(63) Continuation of application No. PCT/JP03/02314, filed on Feb. 28, 2003.

(30) Foreign Application Priority Data

Feb. 28, 2002 (JP) ..... 2002-054194

(51) Int. Cl.[7] ..... G03G 15/09

(52) U.S. Cl. ..... 399/269; 399/276; 399/277; 430/122

(58) Field of Search ..... 399/269, 267, 399/270, 254, 66, 277, 53, 276; 430/120, 122

(56) References Cited

U.S. PATENT DOCUMENTS 3,977,361 A * 8/1976 Nagashima et al. ..... 399/267
4,436,055 A * 3/1984 Yamashita et al. ..... 399/269

(Continued)

FOREIGN PATENT DOCUMENTS

| | | | |
|---|---|---|---|
| EP | 0 899 617 A1 | | 3/1999 |
| JP | 55-32060 | | 3/1980 |
| JP | 56-14268 | | 2/1981 |
| JP | 56-144452 | | 11/1981 |
| JP | 58-68051 | | 4/1983 |
| JP | 59-165082 | | 9/1984 |
| JP | 59-181362 | | 10/1984 |
| JP | 60-051848 | * | 3/1985 |
| JP | 60-176069 | | 9/1985 |
| JP | 01-321460 | * | 12/1989 |
| JP | 8-202140 | | 8/1996 |
| JP | 09-106188 | * | 4/1997 |
| JP | 10-186784 | | 7/1998 |
| JP | 11-212366 | | 8/1998 |
| JP | P2000-98716 | | 4/2000 |
| JP | P2000-338782 | | 12/2000 |

*Primary Examiner*—Sophia S. Chen
(74) *Attorney, Agent, or Firm*—Fitzpatrick, Cella, Harper & Scinto

(57) ABSTRACT

A developing apparatus includes a developer container containing a magnetic developer including a toner and a wax contained in the toner. First and second developer carrying members are rotatably provided in the developer container, for carrying the magnetic developer. A regulation member regulates a thickness of a layer of the magnetic developer carried on the first developer carrying member. A first magnet has a first magnetic pole disposed opposite to the second developer carrying member and a second magnetic pole, which is a subsequent magnetic pole, dispose downstream from the first magnetic pole in a rotation direction of the first developer carrying member and having a polarity identical to a polarity of the first magnetic pole. A second magnet has a third magnetic pole, which has a polarity opposite to a polarity of the first magnetic pole, is disposed opposite to the first developer carrying member.

11 Claims, 5 Drawing Sheets

U.S. PATENT DOCUMENTS 4,496,644 A 1/1985 Ateya et al. ..... 430/122
4,557,992 A 12/1985 Haneda et al. ..... 430/122
4,841,332 A 6/1989 Haneda et al. ..... 399/270
6,001,525 A * 12/1999 Ida et al. ..... 430/122 X
6,055,401 A * 4/2000 Tonomoto et al. ..... 399/269
6,167,211 A * 12/2000 Oogi et al. ..... 399/66 X
6,259,876 B1 * 7/2001 Fukuda et al. ..... 399/254
6,312,862 B1 * 11/2001 Okado et al. ..... 430/108.3
6,438,344 B1 * 8/2002 Fujimoto ..... 399/254
6,459,862 B1 10/2002 Sakemi et al. ..... 399/55
6,473,584 B1 10/2002 Hibino et al. ..... 399/254
6,813,462 B2 * 11/2004 Mitsuya et al. ..... 399/269
2002/0044797 A1 * 4/2002 Itoh ..... 399/269
2002/0054773 A1 * 5/2002 Shirai ..... 399/269
2002/0127488 A1 * 9/2002 Suzuki et al. ..... 399/269 X

* cited by examiner

DEVELOPING APPARATUS INCLUDING FIRST AND SECOND MAGNETS WITH POLES ARRANGED TO SUPPLY DEVELOPER WITHOUT CONTAMINATION

This application is a continuation of PCT Patent application Ser. No. PCT/JP03/02314, filed Feb. 28, 2003.

TECHNICAL FIELD

The present invention relates to a developing apparatus for developing an electrostatic latent image formed on an image bearing member according to electrophotography, electrostatic recording, etc., and particularly relates to a developing apparatus for use in a copying machine, a printer, a recording picture display apparatus, a facsimile machine, etc.

BACKGROUND ART

Heretofore, in an image forming apparatus according to electrophotography, electrostatic recording, etc., a method wherein a dry developer as a picture-visualizing agent is carried on the surface of a developer carrying member and then is conveyed and supplied to a position in proximity to the surface of an image bearing member carrying thereon an electrostatic latent image, followed by application of an alternating electric field between the image bearing member and the developer carrying member to develop the electrostatic latent image for visualization, has been widely known.

Incidentally, as the developer carrying member, a developing sleeve has been generally used in many cases. Accordingly, hereinafter, the developer carrying member is referred to as "developing sleeve". Further, as the image bearing member, a photosensitive drum has been generally used in many cases. Accordingly, hereinafter, the image bearing member is referred to as "photosensitive drum".

As the aforementioned developing method, a so-called magnetic brush developing method wherein a magnetic brush is formed on the surface of a developing sleeve containing a magnet therein with, e.g., a developer composed of two components (magnetic carrier particles and toner particles) (two-component-type developer) and is caused to the magnetic brush with a minute developing gap, followed by successive application of an alternating electric field to the gap between the developing sleeve and the photosensitive drum (between S–D) to repetitively cause transfer and counter transfer from the developing sleeve side to the photosensitive drum side, thus effecting development, has been known (Japanese Laid-Open Patent Application (JP-A) SHO 55-32060 and JP-A SHO 59-165082).

Further, a non-contact type alternating electric field developing method using the two component-type developer for the purpose of a simple color development or a multiple image development has also been known (JP-A SHO 56-14268, JP-A SHO 58-68051, JP-A SHO 56-144452, JP-A-SHO 59-181362, and JP-A SHO 60-176069).

Hereinbelow, a conventional developing apparatus will be described in detail with reference to FIG. 7.

A developing apparatus 101 comprises a developer container in which a developing chamber 116 and a stirring chamber 117 are partitioned by a partition wall 103 and above the stirring chamber 117, a toner storage chamber 118 is located and contains a replenishing toner 111. From a replenishing port 112 disposed at the bottom of the toner storage chamber, the stirring chamber 117 is replenished with the toner 111 by falling replenishment. On the other hand, a developer 113 comprising particles of the toner and a magnetic carrier mixed with the toner particles is contained in the developer chamber 116 and the stirring chamber 117.

In the developer chamber 116, a conveying screw 104 is incorporated and conveys the developer in a longitudinal direction of a developing sleeve 106. A conveying direction of the developer by a conveying screw 105 within the stirring chamber 117 is opposite from that of the conveying screw 104, so that the developer chamber 116 and the stirring chamber 117 through openings provided to the partition wall 103 on its near and far sides.

The developer container 102 is provided with an opening at the position closer to a photosensitive drum 121, and the nonmagnetic developing sleeve 106 is disposed at the opening.

The toner supplied to the stirring chamber 117 by falling replenishment is mixed with the developer under stirring by the screw 105 and then is conveyed to the developing chamber 116. The thus well stirred developer 113 is supplied to the developing sleeve 106 by the screw 104.

The developing sleeve 106 is rotated in a direction of an arrow b (in a direction opposite from the rotation direction of the photosensitive drum 121) and the developer 113 is subjected to regulation in layer thickness by a layer thickness regulation blade (108 disposed at an upper end of the opening of the developer container 102 to have an appropriate layer thickness, thus being carried and conveyed to a developing portion 114.

The magnetic brush of the developer carried on the developing sleeve 106 contacts the photosensitive drum 121 rotating in a direction of an arrow a at the developing portion 114, where the electrostatic latent image formed on the surface of the photosensitive drum 121 is developed.

In the developing sleeve 106, a roller-shaped magnet 107 is fixedly disposed. The magnet 107 has a development magnetic pole (S1 in this embodiment) facing the developing portion 114. The magnetic brush of the developer 113 is formed by a development magnetic field generated at the developing portion 114 and then contacts the photosensitive drum 121 to develop the electrostatic latent image. At that time, the toner attached to the magnetic brush and the toner attached to the surface of the developing sleeve 106 are transferred onto an image forming region of the electrostatic latent image to develop the electrostatic latent image, thus forming a toner image.

Incidentally, in recent years, a sharp melting-type toner has been developed in order to provide a copying machine, a printer, etc., with further improved characteristics in terms of speed, image quality and power consumption. The sharp melting-type toner is more easily melted than the conventional toner when these toners are supplied with an identical amount of heat, so that the sharp meting-type toner is effective in the case of fixation in a short time required of the high speed machine or in reduction of power consumption.

However, when the two component-type development is performed by using the sharp melting-type toner, the toner is liable to be melted. As a result, in the case where the toner is used for a developing sleeve surface-treated by sandblasting in the conventional magnetic brush developing method employing the two component-type developer and the alternating electric field, a toner or a component thereof is more likely to melt-attach to projections and pits at the roughened surface of the developing sleeve during the use for a long time (so-called "sleeve contamination (or toner melt-sticking) phenomenon").

The degree of sleeve contamination phenomenon tends to vary when a magnetic flux density of an S2 pole substantially opposite to the layer thickness regulation blade 108 of the developing apparatus 101. For example, when the magnetic flux density is decreased from 100 mT to 60 mT, the degree of sleeve contamination becomes better one. For this reason, the sleeve contamination phenomenon may be considered to occur principally in the vicinity of the layer thickness regulation blade 108 by the action of magnetic and mechanical regulation forces.

Such a sleeve contamination phenomenon is liable to occur when the developing sleeve 106 is rotated at high speed in order to meet the trend of speeding up of the copying machine or printer. This phenomenon becomes problematic when the developing sleeve 106 is rotated at a peripheral speed of at least 350 mm/s, particularly at least 50 mm/s.

When the toner melt-sticking (sleeve contamination) is caused to occur at the surface of the developing sleeve 106, a conveyance amount of the developer 113 to the developing portion 114 is lowered and then the resultant image density is lowered.

Further, in order to perform a good development, a developing bias superposed with a DC voltage and/or an AC voltage has been conventionally applied to the developing sleeve 106 at the time of development. However, when the toner melt-sticking is caused to occur, a high-resistance layer of the melted product is formed on the sleeve surface, whereby a desired electric field is not generated at the developing portion 114 located between the developing sleeve 106 and the photosensitive drum 121 at the time of development. As a result, a sufficient development effect by the developing bias cannot be obtained to cause a lowering in image density or image failure due to a so-called highlighted edge, such as thickened image back end, sweeping and white dropout.

These problems can be remedied to some degrees by adjusting a surface roughness of the developing sleeve 106. For example, as described in JP-A HEI 8-202140, an average spacing or interval Sm between adjacent two peaks at the surface of the developing sleeve 106 is made at most a predetermined value, whereby it is possible to realize a developing sleeve having a longer operating life to some extent even in the case of using a developer causing a sleeve contamination on the conventional developing sleeve resulting in a shorter operating life.

However, in recent years, a toner which per se contains, e.g., a wax component for simplifying an apparatus construction through oil-less fixation has been developed.

In the case of using such a toner, a pressure is exerted on the toner when the toner or the like rubs the developing sleeve while being held by the magnetic brush, so that the wax component nigrate to the toner surface to attach to the developing sleeve. In addition, the toner or the toner component is also attached to the developing sleeve. As a result, we have confirmed that the developing sleeve contamination phenomenon is noticeable when compared with the conventional toner containing no wax component. Accordingly, in the case of the wax-containing toner, it is considered to be difficult to provide a longer operating life even when the sleeve surface state is somewhat improved.

Further, the sleeve contamination phenomenon is noticeable in the case of using the two component-type developer comprising the toner and the magnetic carrier compared with the case of a monocomponent development scheme. This may be attributable to such a phenomenon that the toner electrostatically attached to the magnetic carrier is pressed against the developing sleeve by a magnetic force exerted between the magnetic carrier and the magnet disposed within the developing sleeve, so that the above-mentioned wax component is liable to attach to the developing sleeve in the case of the two component development scheme compared with the monocomponent development scheme thus contaminating the developing sleeve.

Further, in the case of the developing apparatus using the monocomponent developer, the developing apparatus is relatively frequently used in the form of a so-called (process) cartridge prepared by integrally supporting the developing apparatus together with the photosensitive drum, etc., so that the developing apparatus including the particle size is replaced together with the photosensitive drum in many cases at the time of replacement of the photosensitive drum due to its wearing-out. As a result, the operating life of the developing sleeve may be sufficient if it allows image formation on about 50,000 sheets.

On the other hand, in the case of the developing apparatus using the two component-type developer, the developing apparatus is provided with a toner-replenishing mechanism, so that the developing apparatus is less used as the cartridge. Further, the replacement only of the developing sleeve is not simple constructionally, so that the developing sleeve is required to have the operating life equivalent to that of the developing apparatus. For example, the developing sleeve is required to have an operating life allowing image formation on at least 100,000 sheets, preferred at least 400,000 sheets, of recording paper.

DISCLOSURE OF INVENTION

An object of the present invention is to provide a developing apparatus capable of preventing image failure occurring at the time of performing a development of an electrostatic latent image formed on an image bearing member by using a developer comprising a toner containing a wax component.

According to the present invention, there is provided a developing apparatus, comprising:

a developer container containing a magnetic developer comprising a toner and a wax contained in the toner, first and second developer carrying members, rotatably provided in the developer container, for carrying the magnetic developer, a regulation member for regulating a thickness of a layer of the magnetic developer carried on the first developer carrying member, and magnetic field generation means for generating a magnetic field for transferring the magnetic developer from the first developer carrying member to the second developer carrying member, wherein the first and second developer carrying members develop a common electrostatic latent image formed on an image bearing member is developed with the developer carried on the first developer carrying member and the developer carried on the second developer carrying member in this order.

These and other objects, features and advantages of the present invention will become more apparent upon a consideration of the following description of the preferred embodiments of the present invention taken in conjunction with the accompanying drawings.

BEST MODE FOR PRACTICING THE INVENTION

Hereinbelow, an image forming apparatus using the developing apparatus according to the present invention will be specifically explained with reference to the drawings.

Embodiment 1

Figure 1:
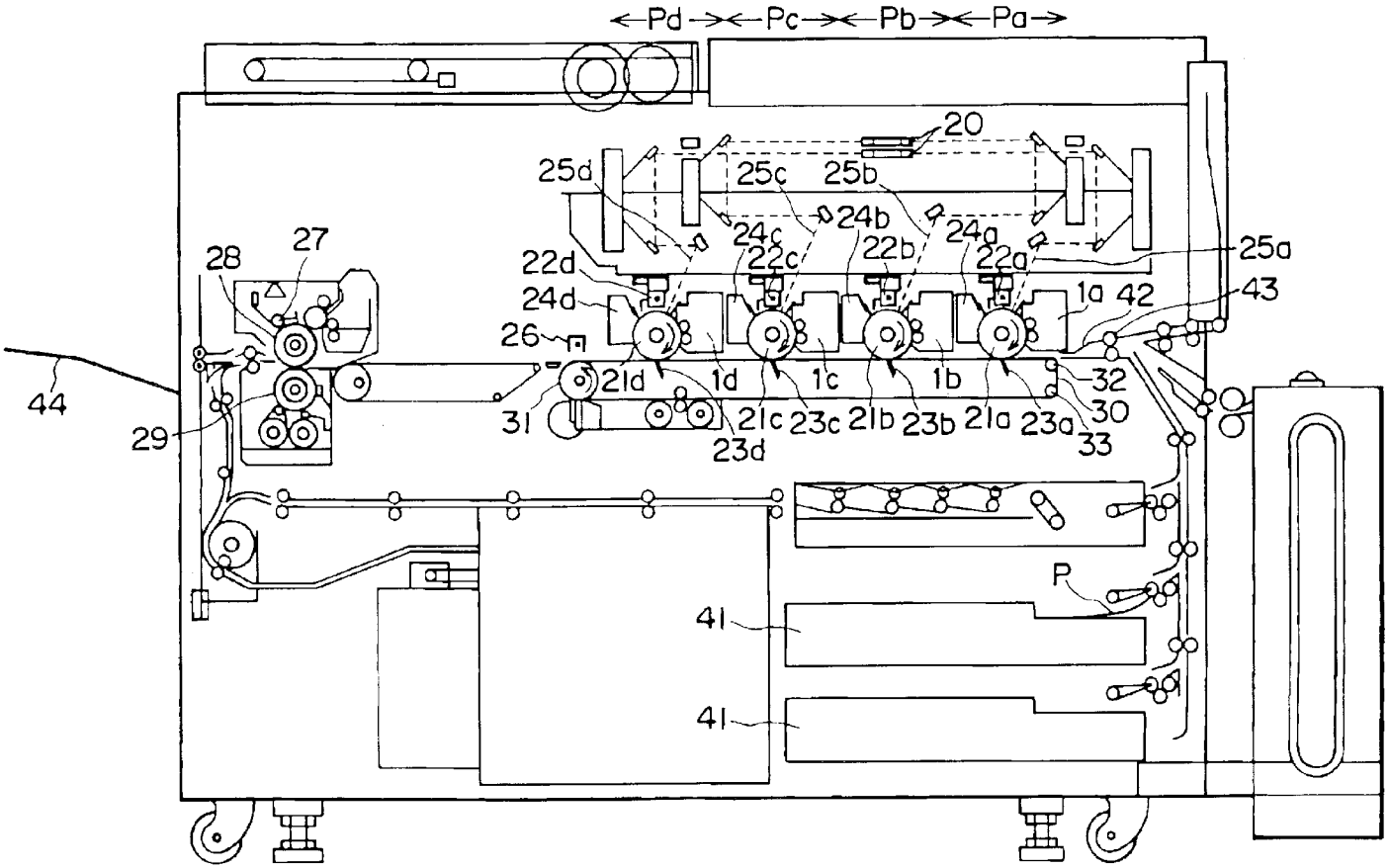
FIG. 1 is a schematic sectional view showing an embodiment of an image forming apparatus including the developing apparatus according to the present invention.

With reference to FIG. 1, an embodiment of a general construction of a color electrophotographic image forming apparatus using the developing apparatus according to the present invention will be described in detail but the present invention is not limited to the developing apparatus used in this embodiment.

The image forming apparatus in this embodiment includes a plurality of image bearing members and a plurality of image forming sections.

Inside the image forming apparatus body, image forming sections Pa, Pb, Pc and Pd each containing processing means are disposed in a horizontal (longitudinal) direction on the drawing. At a lower part of each of the image forming sections Pa, Pb, Pc and Pd, an endless belt-shaped transfer belt 30 is wound about belt drive rollers 31, 32 and 33. The transfer belt 30 is rotated by driving the belt drive roller 31 in a direction of an arrow by means of a drive roller (not shown). Cassettes 41 contain recording sheets P as a recording medium, and each recording sheet P is first supplied from the upper cassette 41. The supplied recording sheet P is corrected on oblique feeding by a pair of register rollers 43 and conveyed onto the transfer belt 30 in synchronism with operations at the image forming sections Pa, Pb, Pc and Pd. A conveyance guide 42 guides the recording sheet P from the register rollers 43 to the transfer belt 30.

The image forming sections Pa, Pb, Pc and Pd include photosensitive drums 21*a*, 21*b*, 21*c* and 21*d* as image bearing members, respectively. Around the photosensitive drum 21*a*, 21*b*, 21*c* and 21*d*; the processing means comprising primary chargers 22*a*, 22*b*, 22*c* and 22*d* as charging means, developing apparatus 1*a*, 1*b*. 1*c* and 1*d* as developing means, transfer chargers 23*a*, 23*b*, 23*c* and 23*d* as transfer means, cleaning apparatus 24*a*, 24*b*, 24*c*, 24*d* as cleaning means, and exposure light sources 25*a*, 25*b*, 25*c* and 25*d* as electrostatic latent image forming means are disposed, respectively. Above the photosensitive drums 21*a* to 21*d*, a laser beam scanner 20 is disposed.

The primary chargers 22*a*–22*d* uniformly charge the surfaces of the photosensitive drums 21*a*–21*d*, respectively, in advance of exposure thereof to light. The developing apparatus 1*a*–1*d* attach respective toners of black, magenta, yellow and cyan to electrostatic latent images formed on the surfaces of the photosensitive drums 21*a*–21*d*, respectively, through the exposure to visualize the electrostatic latent images. thus forming a toner image. Further, the transfer chargers, 23*a*–23*d* transfer the toner image formed on the photosensitive drums 21*a*–21*d* onto a recording sheet P. The cleaning apparatus 24*a*–24*d* remove a transfer residual toner attached to the surfaces of the photosensitive drums 21*a*–21*d* after the image transfer.

The exposure light sources 25*a*–25*d* remove surface potentials at the surfaces of the photosensitive drums 21*a*–21*d*, and the laser beam scanner 20 comprises a semiconductor laser, a polygon mirror, fθ lens, etc., and is supplied with an electrical digital image signal and then irradiates the photosensitive drums 21*a*–21*d* in their generatrix direction with a laser beam modulated in correspondence to the image signal, thus effecting exposure.

A separation charger 26 separates the recording sheet P conveyed on the transfer belt 30. A fixing device 27 is a fixing means for fixing a transfer image transferred onto the recording sheet P, and includes a fixing roller 28 containing therein a heating means such as a heater, and a pressure roller 29 pressed against the fixing roller 28. A discharge tray 44 is a means for loading thereon the discharged recording sheet P.

Next, an image forming operation will be explained.

When an image forming operation starting signal is inputted into the apparatus body, the photosensitive drum 21*a* starts on a rotation in a direction of an arrow and is uniformly charged by the primary charger 22*a*, followed by irradiation at the photosensitive drum surface with a laser beam modulated by an image signal corresponding to a black component of an original image by means of the laser beam scanner 20 to form an electrostatic latent image (exposure operation). Then, the electrostatic latent image is visualized by supplying a black toner from the developing apparatus 1*a* to form a toner image.

On the other hand, the recording sheet P contained in the cassette 41 is fed therefrom, and after being subjected to correction of oblique feeding by the pair of register rollers 43 which are temporarily paused, is carried onto the transfer belt 30 in timing with the toner image formed on the photosensitive drum 21. The recording sheet P carried onto the transfer belt 30 is charged for transfer by the transfer charger 23*a* at a transfer portion of the image forming section Pa, whereby the toner image is transferred onto the recording sheet P.

The above steps are similarly performed with respect to the image forming sections Pb, Pc and Pd, so that a magenta toner image, a yellow toner image, and a cyan toner image are successively transferred onto the recording sheet P.

The recording sheet P after completion of the image transfer is separated from the transfer belt 30 at the left end portion of the transfer belt 30 while being subjected to AC charge removal by the separation charger 26, followed by conveyance to the fixing device 27. Thereafter, the recording sheet P after being subjected to the image fixation by the fixing device 27 is discharged outside the discharge tray 44.

Next, nonmagnetic toner particles used in the present invention will be described.

The toner particles used in the present invention are prepared as a pulverization toner containing a wax component in order to realize the oil-less fixation described above with respect to the conventional art.

In this embodiment, the toner particles are prepared by kneading a binder resin, a wax, a colorant and a charge control agent, pulverizing the kneaded product and then classifying the pulverized product. The preparation of the toner particles may be effected by another method, such as a freeze pulverization method through kneading, and may also contain other additives.

The pulverization toner can be prepared relatively inexpensively compared with another toner such as a polymerization toner, but the wax component of the pulverization toner is liable to present in the vicinity of a surface layer of toner particle. For this reason, the wax component migrate readily to the developing sleeve as a developer carrying member, so that the developing sleeve is liable to be contaminated by the wax component. When a toner contains a wax in an amount of 1–20 wt. %, a sleeve contamination phenomenon is generally liable to occur. However, in the case of producing the toner through the pulverization method, the sleeve contamination phenomenon becomes noticeable when the wax is used in an amount of at least 15 wt. %, particularly at least 10 wt. %, for a high-speed apparatus. In addition thereto, the wax is attached to the magnetic carrier to deteriorate the developer.

Further, such a sleeve contamination (toner melt sticking) phenomenon is liable to occur when the developing sleeve is rotated at high speed in order to meet the trend of speeding up of the copying machine or the printer, particularly when a peripheral speed of the developing sleeve is at least 350 mm/sec, further at least 500 mm/sec. On the other hand, when the developing sleeve is rotated at a peripheral speed of 1000 mm/sec or higher, a toner scattering from the developing speed due to a centrifugal force becomes problematic. Accordingly, in the present invention, the peripheral speed of the developing speed may preferably be set in the range of 350–1000 mm/sec.

In this embodiment, an adverse influence on a resultant image is reduced by using a developing apparatus described hereinbelow.

In this embodiment, each of the developing apparatuses 1*a*–1*d* used in the image forming apparatus shown in FIG. 1 has an identical construction and thus will be described as a developing apparatus 1 shown in FIG. 2 which corresponds to an enlarged view of each of the developing apparatuses 1*a*–1*d*.

Figure 2:
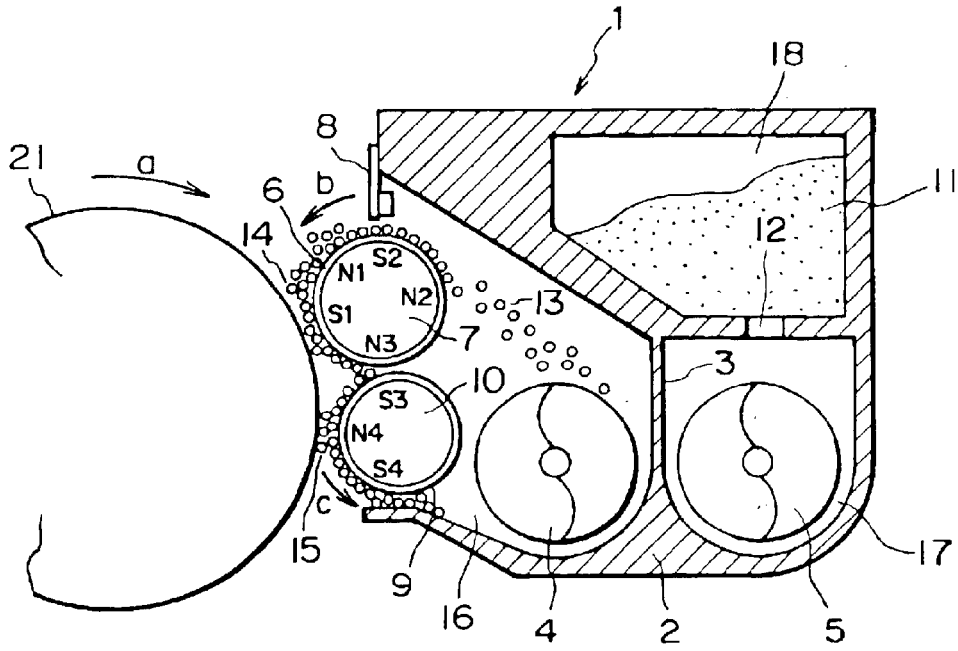
FIG. 2 is a schematic sectional view showing an embodiment of the developing apparatus of the present invention.

Referring to FIG. 2, the developing apparatus 1 (corresponding to the developing apparatus 1*a*, 1*b*, 1*c* or 1*d*) includes a developer container 2 in which a developing chamber 16 and a stirring chamber 17 are partitioned by a partition wall 3 and above the stirring chamber 17, a toner storage chamber 18 is located and contains a replenishing toner 11. From a replenishing port 12 disposed at the bottom of the toner storage chamber 18, the stirring chamber 17 is replenished with a toner in an amount corresponding to a consumed amount thereof in developing step, as desired, by falling replenishment. On the other hand, a developer 13 (magnetic developer) comprising particles of the nonmagnetic toner and a magnetic carrier mixed with the nonmagnetic toner particles is contained in the developer chamber 16 and the stirring chamber 17. The magnetic carrier used in the present invention may, e.g., be a ferrite carrier or a resinous magnetic carrier comprising a binder resin, a magnetic metal oxide and a nonmagnetic metal oxide.

In the developer chamber 16, a conveying screw 4 is incorporated and conveys the developer by its rotational drive in a longitudinal direction of a developing sleeve 6. A conveying direction of the developer by a conveying screw 5 within the stirring chamber 17 is opposite from that of the conveying screw 4.

The partition wall 3 is provided with communicating openings on its near and far sides. The developer carried by the screw 4 is transferred to the screw 5 through one of the openings and that carried by the screw 5 is transferred to the screw 4 through the other opening.

As a result, the toner supplied to the stirring chamber 17 by falling replenishment and the developer 13 are sufficiently mixed under stirring by the screw 5 and carried to the developing chamber 16 to be subjected to development. A part of the developer 13 after the development is returned to the stirring chamber and is replenished with a toner 11 in an amount corresponding to a consumed amount of the developer in the development step. As a result, the developer 13 is circulated so that it is always subjected to development in a fresh state.

The above-mentioned construction of the developing apparatus 1 is substantially identical to that of the conventional developing apparatus 101 described above.

The developing apparatus 1 according to the present invention is, however, characterized by having a pair of developing sleeves 6 and 9 for carrying the developer 13 within the developer container 2 to developing portions 14 and 15.

In this embodiment (FIG. 2), at an opening of the developer container 2 close to a photosensitive drum 21, two sleeves consisting of a first developing sleeve 6 (as a first developer carrying member), formed of a material such as aluminum or nonmagnetic stainless steel, and provided with an appropriate surface unevenness (projections and pits) and a second developing sleeve 9 are disposed.

The first developing sleeve 6 rotates in a direction of an arrow b (opposite from a rotation direction a of the photosensitive drum 21) at a peripheral speed Vb. The first developing sleeve 6 carries and conveys the developer 13 to the first developing portion 14 after the developer 13 carried on the first developing sleeve 6 is appropriately regulated in its layer thickness by a regulating blade 8 disposed at an upper end of the opening of the developer container 2.

In this embodiment, as the regulating blade 8, a blade comprising a nonmagnetic plate and a magnetic plate bonded to the nonmagnetic plate is used.

Within the developing sleeve 6, a roller-shaped first magnetic field generation means (magnet) 7 is fixedly disposed. The magnet 7 has a development magnetic pole (S1 in this embodiment) facing the first developing portion 14. A magnetic brush is formed by erecting a chain of the developer 13 by the action of developing magnetic field created at the first developing portion 14 by the development magnetic pole S1. The magnetic brush contacts the photosensitive drum 21 rotating at a peripheral speed Va in a direction of an arrow a at the first developing portion 14 to develop an electrostatic latent image formed on the peripheral surface of the photosensitive drum 21 at the first developing portion 14. At that time, the toner attached to the magnetic brush and that attached to the surface of the developing sleeve 6 are also transferred to an image region of the electrostatic latent image.

In this embodiment, the first magnet 7 has magnetic poles N1, N2, N3 and S2 other than the development magnetic pole S1. Of these magnetic poles, the N3 pole located downstream of the development magnetic pole S1 in the moving (rotation) direction b of the first developing sleeve 7 and the N2 pole located downstream of the N3 pole within the developer container 2 are adjacent to and identical in polarity to each other to form a repulsive magnetic field. The repulsive magnetic field prevents the developer 13 from entering the developing chamber 16 from the opposite position between the first and second developing sleeves 6 and 7 and forms a barrier against the developer 13 in the vicinity of the opposite position between the developing sleeves 6 and 7 so that only the developer 13, sufficiently stirred within the developing chamber 16, drawn by the N2 pole is carried to the position of the regulating blade 8. The developer 13 drawn by the N2 pole within the developer container 2 from the developing chamber 16 so as to avoid a region between the N2 and N3 poles opposite in polarity to each other is regulated in its amount (layer thickness) at the magnetic pole S2 located opposite to the regulating blade 6 in accordance with the rotation of the developing sleeve 6, and moves outside the developer container 2, followed by passing through the magnetic pole N1 to reach the development magnetic pole S1. The N3 pole is located downstream of an opposite position between the development magnetic pole S1 of the developing sleeve 6 and the photosensitive drum 21.

In this embodiment, the second developing sleeve 9 as the second developer carrying member is disposed rotatably in the developing chamber 16 in a direction of an arrow c identical to the rotation direction b of the first developing sleeve 6 at a peripheral speed Vc so that the second developing sleeve 9 is disposed in parallel with the first developing sleeve 6 at the opening of the developer container 2 in a region substantially facing to both the first developing sleeve 6 and the photosensitive drum 21.

The second developing sleeve 9 is formed of a nonmagnetic material similarly as the first developing sleeve 6 and contains therein a roller-shaped magnetic field generation means (magnet) 10 (as the magnetic field generation means) disposed in a nonrotational state.

The second developing sleeve 9 has three magnetic poles S3, N4 and S4. Of the magnetic poles, the N4 pole is a second development magnetic pole facing the photosensitive drum 21 at the second developing portion 15, and effects second development of the electrostatic latent image carried on the surface of the photosensitive drum 21 after passing through the first developing portion 14, at the second developing portion.

The developer after the development at the second developing portion 16 is carried from the development magnetic pole N4 to the magnetic pole S4 to be returned to the inside of the developer container 2.

Further, the S3 pole located upstream of the development magnetic pole N4 and facing the first developing sleeve 6 and the S4 pole adjacently located upstream of the S3 pole and within the developer container 2 have an identical polarity, thus creating a repulsive magnetic field between the S3 and S4 poles. As a result, the developer after the development returned to the inside of the developer container 2 via the developing portion 15 is detached from the second developing sleeve 9 to be lead into the developing chamber 16. Thus, a barrier against the developer 13 is created in the vicinity of the lower end of the opening of the developer container 2.

The S3 pole of the second developing sleeve 9 is opposite to the N3 pole of the first magnet 7 included in the first developing sleeve 6 in the vicinity of a position closest to the N3 pole.

As described above, the S3 pole and the N3 pole are set to have a mutually opposite polarity, so that the magnetic field formed between these two magnetic poles allows the transfer of the developer from the first developing sleeve 6 to the second developing sleeve 9. Accordingly, it is not necessary to dispose a regulating member, such as the regulating blade 8, around the second developing sleeve 9.

Hereinbelow, the carrying operation of the developer 13 will be specifically described with reference to FIG. 3 which is an enlarged view showing the first developing sleeve 6 and the second developing sleeve 9.

Figure 3:
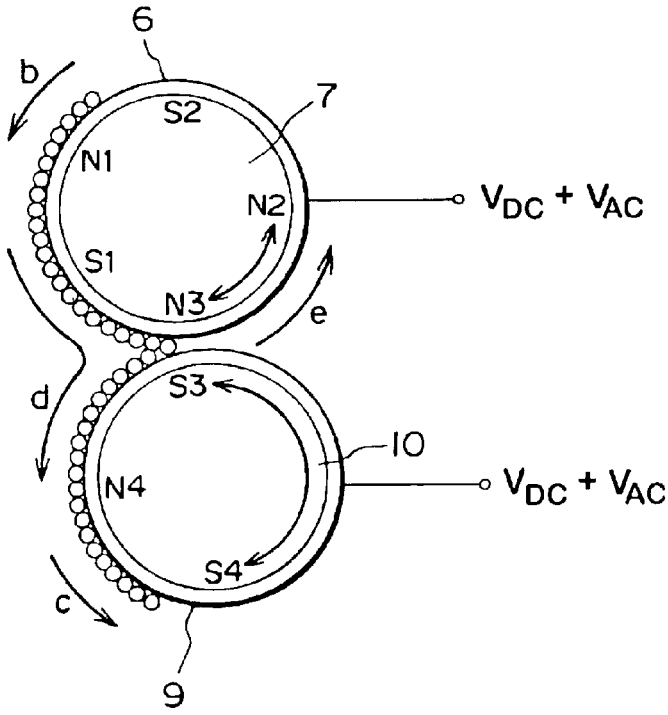
FIG. 3 is an enlarged sectional view showing first and second developer carrying members used in the present invention.

Referring to FIG. 3, a repulsive magnetic field is created between the N3 and N2 poles of the first developing sleeve 6 and between the S3 and S4 poles of the second developing sleeve 9, so that the developer 13 subjected to layer thickness regulation by the regulating blade 8 is carried on the first developing sleeve 6 to reach the N3 pole through the developing portion 14. The developer 13 cannot pass through a closest position between the first and second developing sleeves 6 and 9 in a direction of an arrow e but moves to the second developing sleeve 9 side by the action of line of magnetic force extending from the N3 pole to the S3 pole as shown by an arrow d. Then, the developer 13 is carried on the second developing sleeve 9 in accordance with the rotation of the developing sleeve 9 and at the inside of the developer container 2, is detached from the developing sleeve 9 by the action of the repulsive magnetic field between the S3 and S4 poles to be carried to the conveyance screw 4 (FIG. 2).

As described above, in this embodiment, the second developing sleeve 9 is disposed below the first developing sleeve 6, so that the developer is first carried on the first developing sleeve 6 while following the course of N2 inside the developing sleeve 6, S2 opposing the regulating blade 8, N1, the first development magnetic pole S1, and N3 and then is blocked by the repulsive magnetic fields between the N2 and N3 poles of the first developing sleeve 6 and between the S3 and D4 poles of the developing sleeve 9, to be moved onto the second developing sleeve 9.

Thereafter, the developer is carried on the second developing sleeve 9 from the S3 pole to the S4 pole via the second development magnetic pole N4 and is blocked at the S4 pole by the repulsive magnetic field to be drawn into the developing chamber 16. Then, a fresh developer is drawn toward the first developing sleeve 9 in the vicinity of the. N2 pole of the first magnet 7.

We have conducted experiments on the soiling of developing sleeve with the wax component in the case of performing image formation for a long period by using the developing apparatus 1 used in this embodiment. As a result, we have confirmed that, even when the sleeve contamination phenomenon such that a part of the toner and/or toner component in the developer 13 attaches to the surface of the first developing sleeve is caused to occur noticeably, such a sleeve contamination phenomenon hardly occurs at the surface of the second developing sleeve 9.

This may be principally attributable to the magnetic and mechanical shearing force in the vicinity of the layer thickness regulating blade 8 as described also with respect to the conventional developing apparatus. This is estimated based on such a phenomenon that a degree of the sleeve contamination varies depending on a charge in magnetic flux density of the magnetic pole substantially opposite to the regulating blade 8 (S2 in this embodiment).

From the above-described viewpoint, according to the developing apparatus in this embodiment, although the first developing sleeve 6 is disposed substantially opposite to the layer thickness regulating blade 8, the second developing sleeve 9 receives the developer 13 already regulated by the first developing sleeve 6. As a result, it is unnecessary to dispose the layer thickness regulating blade 8 for the second developing sleeve 9. For this reason, a shearing force exerted on the second developing sleeve 9 for pressing the developer 13 against the developing sleeve 9 is reduced, thus little causing the sleeve contamination.

When the developing apparatus after the above image formation for a long period is further subjected to image formation, although the first developing sleeve 6 causes the sleeve contamination, image failure resulting from the edge effect, such as so-called sweeping or white dropout, is little observed.

This may be attributable to the following mechanism.

The first developing sleeve 6 is contaminated the sleeve surface has a high resistance or the pits or depressions of the roughened sleeve surface is filled up), so that there is a possibility that an image formed on the photosensitive drum 1 after developed at the first developing portion 14 by the first developing sleeve 6 causes image failure due to a lowering in image density or the edge effect. However, the developing apparatus 1 in this embodiment is further provided with the second developing sleeve 9 downstream of the first developing sleeve 6 to allow second development at the second developing portion 15. As described above, the second developing sleeve 9 is not required to have the layer thickness regulating member, so that the shearing force pressing the developer against the second developing sleeve 9 is reduced, thus being considerably less liable to cause the sleeve contamination.

Accordingly, even if the image failure is caused to occur on the first developing sleeve 6 contaminated or soiled with the toner (component) in the first development, the second development is performed by the second developing sleeve 9 little soiled with the toner to correct or remedy the image failure. For example, with respect to the density lowering as one of the difficulties due to the sleeve soiling it becomes possible to sufficiently attach the toner onto the electrostatic latent image on the photosensitive member by effecting the second development. At that time, the second developing sleeve 9 is not contaminated with the toner, so that an effect as a counter electrode against the photosensitive drum 21 is sufficiently expected. As a result, a desired electric field less affected by the edge effect is formed to allow formation of an image free from image failure, such as sweeping or white dropout, due to the edge effect.

As described above, by adopting a system wherein the developing apparatus is provided with the (first and second) developing sleeves and the developer is transferred from the first developing sleeve regulated in layer thickness of the developer to the second developer, it is not necessary to provide the layer thickness regulating blade to the second developing sleeve, which is not contaminated even when the wax-containing toner is employed. As a result, the image failure is effectively suppressed even if the sleeve contamination occurs at the first developing sleeve. In other words, in the present invention, it is possible to adopt the oil-less fixation with no problem.

The above-mentioned first and second developing sleeves 6 and 9 will be further described in detail below.

As described in the case of the conventional developing apparatus, the sleeve contamination phenomenon, such as melt sticking of the toner or toner component onto the (first or second) developing sleeve, occurs at the surface of the developing sleeve subjected to sand blasting treatment for roughening the sleeve surface with irregular particle comprising, e.g., alumina by the use of the developing apparatus for a long period during which the toner or toner component is catched at pits (valleys) on the roughened sleeve surface to attach to the pits.

The toner attached to the pits of the developing sleeve surface is considered to cause melt sticking to the developing sleeve surface by frictional heat resulting rom a pressing force by, e.g., the layer thickness regulating member for regulating a layer thickness of the developer at the sleeve surface during the use of the developing apparatus for a long period.

In order to prevent the developing sleeve contamination, we have effected blasting surface treatment with glass beads to the developing sleeve surface. The blasting treatment with glass beads as spherical particles, compared with the above-mentioned sand blasting treatment using the irregular-particles, provides a smaller ratio Rz/Sm which is a value obtained by dividing a ten-point average roughness Rz of the developing sleeve surface by an average interval (spacing) Sm between adjacent two peaks of the uneven developing sleeve surface.

More specifically, Rz represents a difference in height between a peak and a valley of the uneven developing sleeve surface, and S represents an average interval between a peak and a peak adjacent thereto of the uneven developing sleeve surface. Accordingly, the ratio Rz/Sm becomes larger as a slope of the surface roughness becomes steeper, and becomes smaller as the slope becomes gentler, thus resulting in an index representing a degree of smoothness on the developing sleeve surface.

Accordingly, in the production step of the developing sleeve used in the present invention, the surface unevenness of the developing sleeve becomes smoother, so that a pressing force exerted on the toner against the developing sleeve at the uneven surface is reduced to prevent met-sticking of the toner or toner component onto the developing sleeve to some extent.

Particularly, the surface phase of the developing sleeve may preferably satisfy the following conditions (a), (b) and (c):

(a) $0.05 \leqq Rz/Sm \leqq 0.25$, (b) $4\ \mu m \leqq Rz \leqq 30\ \mu m$, and (c) $20\ \mu m \leqq Sm \leqq 120\ \mu m$.

In the case where the ratio Rz/Sm is at most 0.25, as described above, the toner is less liable to be catched at pits or valleys of the uneven developing sleeve surface, thus alleviating a contamination level. However, if the ratio Rz/Sm is smaller than 0.05, the sleeve contamination can be effectively prevented but the sleeve surface becomes smooth excessively, thus resulting in an insufficient developer carrying performance of the developing sleeve to be practically problematic.

Further, if Rz is below 4 $\mu$m, the developer carrying performance becomes insufficient, thus unstabilizing a coating characteristic of the developer on the developing sleeve surface. On the other hand, if Rz is above 30 $\mu$m, the developer carrying performance becomes better but the frictional force exerted on the developer becomes too strong to considerably deteriorate the developer during image formation for a long period.

As for the Sm value, if Sm is below 20 $\mu$m, the sleeve contamination becomes problematic. Further, if Sm is above 120 $\mu$m, the developer carrying performance is lowered by a decrease in the number of projections and recesses at the developing sleeve surface. As a result, the developer is not stably coated on the developing sleeve surface.

Incidentally, the surface treatment method of the developing sleeve is not restricted to the above-mentioned blasting treatment in this embodiment. However, compared with irregular blasting treatment wherein irregular particles of, e.g., sand, alumina, and silicon dioxide, having angularities are blasted at a high speed, a developing sleeve suitable for the above surface conditions is readily prepared by using a regular blasting treatment using particles with less projecting point, such as those of glass beads, stainless steel ball and ceramic ball. Particularly, a processible material for the developing sleeve to be treated may preferably be aluminum.

Next, a measurement method of the surface shape factors Rz and Sm of the developing sleeve described above will be described below with reference to FIG. 4.

The values Rz and Sm referred to herein are values defining the ten-point average roughness and the average internal between adjacent two peaks, respectively, as described in JIS-B0601 and ISO468, and are obtained based on the following definitions.

Ri: a peak value of a difference in height between a peak and a valley $$Sm=(1/n)\Sigma(i=n)(Si)$$

Si: interval (spacing) between adjacent two peaks.

Here, Rz qualitatively represents a difference in height between a peak and an adjacent valley of the uneven developing sleeve surface.

Figure 4:
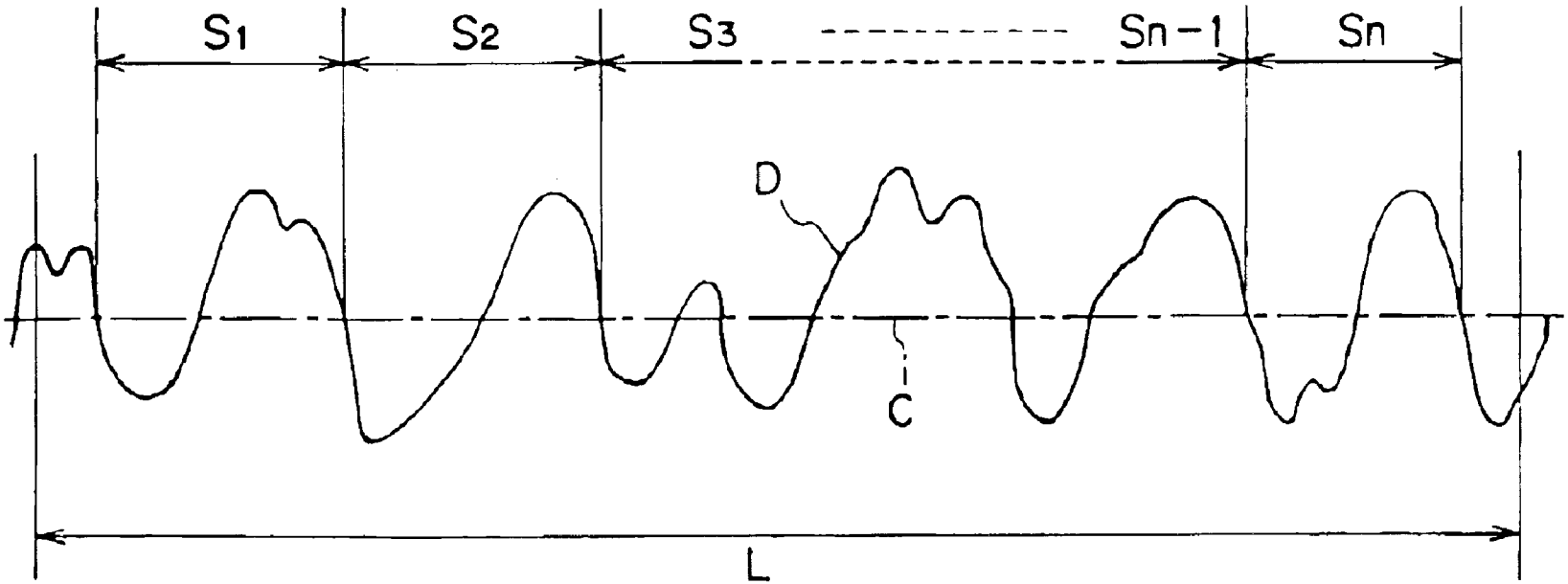
FIG. 4 is a schematic enlarged illustration for showing the surface of a developer carrying member and explaining a surface roughness Rz and an average spacing or interval Sm between adjacent two peaks.

Further, as shown in FIG. 4, Sm represents an arithmetic mean (average) of S1, S2, S2, . . . Sn (n: the total number of peaks (or valleys) within a R1, R2, R3 . . . , Rn within a reference length).

More specifically, referring to FIG. 4, in a reference length (measurement length) L at a section of the roughening-treated (uneven) surface of the developing sleeve, S1 is defined as an interval between a first point on a center line C first crossing a cross-sectional curve D and a second point on the center line C secondarily crossing the curve D. Further, S2 to Sn (Sn: the last interval in the reference length L) are similarly defined as in S1. These values S, S2, . . . Sn are measured and their arithmetic average is defined as Sm, which qualitatively represents an average interval between a peak and a peak adjacent thereto.

The measurement of the surface roughness is performed by using a contact-type surface roughness meter ("Surf-Corder SE-330", available from K.K. Kosaka Kenkyusho) capable of measuring the ten-point average roughness Rz and the average interval Sm between adjacent two peaks at the uneven developing sleeve surface at the same time. The measurement conditions include a cutoff value of 0.8 mm, a reference length (L) of 2.5 mm, a feed speed of 0.1 mm/sec, and a magnification of 5000.

Embodiment 2

This embodiment is identical to Embodiment 1 except that a first developing sleeve 6 is detached from a photosensitive drum 21.

More specifically, in Embodiment 1, the developer carried on the first developing sleeve 6 is subjected to development while contacting the photosensitive drum 21 (FIG. 2), but the first developing sleeve 6 is not necessarily required to be subjected to the developing step if the second developing step 9 allows an ordinary development without causing the sleeve contamination.

Figure 5:
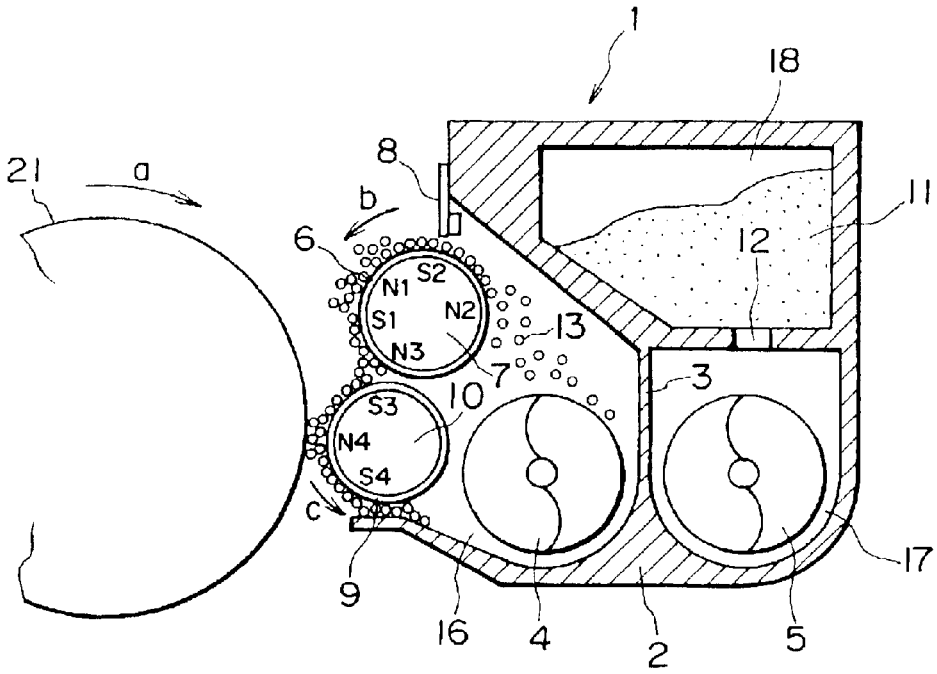
FIGS. 5 and 6 are schematic sectional views each showing another embodiment of the developing apparatus of the present invention.

In this embodiment, as shown in FIG. 5, the first developing sleeve 6 is detached from the photosensitive drum 21, whereby only the developer carried on the second developing sleeve 9 is subjected to development.

Generally, a gap between the developing sleeve and the photosensitive drum is designed to be kept constant since it affects the developing step. However, in this embodiment, the above-described arrangement of the first developing sleeve 6 is adopted, the resultant developing apparatus has the advantage of not requiring a complicated mechanism for keeping the gaps between the first developing sleeve and the photosensitive drum and between the second developing sleeve and the photosensitive drum, respectively, at a constant value.

In this regard, however, the developing apparatus used in Embodiment 1 subjecting the developers carried on the first and second developing sleeves to development is rather advantageous to improve a developing efficiency to provide high qualities to a resultant image, particularly to one having a high image density and a large area.

More specifically, the construction of the developing apparatus used in Embodiment 1 is preferred in the respect that it is possible to realize a high image quality by relocation of the toner attached to the electrostatic latent image formed on the photosensitive drum in the developing step using the second developing sleeve (i.e., he toner is drawn back to the second developing sleeve if the toner is attached to the electrostatic latent image in an excessive amount and is supplied from the second developing sleeve to the electrostatic latent image if the toner supply amount is insufficient).

Embodiment 3

This embodiment is identical to Embodiment 1 except that the pulverization toner is changed to a polymerization toner.

More specifically, in Embodiment 1, the pulverization toner containing the wax component is used but in this embodiment, a polymerization toner containing a wax component is used in order to accomplish the oil-less fixation. The polymerization toner can be prepared while including therein the wax component with a less amount of the wax component exposed to the toner particle surface, thus being less liable to cause the sleeve contamination compared with the wax-containing pulverization toner. In the case of the polymerization toner, however, if the toner contains the wax component in an amount of at least 1 wt. %, particularly at least 3 wt. %, the sleeve contamination is liable to occur. However, in some cases, it is possible to use about 5 wt. % of the wax component in the polymerization toner without causing the sleeve contamination by successfully including the wax component and appropriately selecting a process speed of the apparatus. In such cases, the amount of the wax component, however, has an upper limit of 20 wt. % since the developing sleeve causes the sleeve contamination noticeably and other difficulties are liable to arise particularly in the case of above 15 wt. %.

The polymerization toner may readily be prepared as spherical toner particles by utilizing a suspension polymerization wherein a monomer composition prepared by adding a colorant and a charge control agent to a monomer component for a binder resin is subjected to suspension polymerization in an aqueous medium. In the present invention, however, the polymerization toner may be prepared through other methods such as emulsion polymerization, and may contain other additives to be added in the monomer composition.

Incidentally, if a spherical toner having a shape factor SF-1 of 100–140 and a shape factor SF-2 of 100–120 is used in the present invention, the resultant toner has a good releasability with the photosensitive drum based on its shape factor. As a result, a high transfer efficiency can be attained, and particularly the spherical toner is advantageous to less cause image failure such a a lowering in image density even when the sleeve contamination occurs.

It is easy to prepare the spherical toner by using the above-mentioned production process of the polymerization toner.

The shape factors SF-1 and SF-2 referred to herein are defined as calculated values obtained in the following manner. By using a scanning electron microscope ("FE-SEM (S-800)", available from microscope ("FE-SEM (S-800)", available from K.K. Hitachi Seisakusho), 100 toner particles are sampled at random and their image data are inputted into an image analyzer ("Lusex 3", available from Nireco Co.) via an interface to analyze the image data to provide calculated values for SF-1 an SF-2. The SF-1 value represents a sphericity. The SF-1 value of 100 means that the toner particles are a true sphere and a larger SF-1 value means that the toner particles are gradually deviated from a spherical form to become an irregular form. The SF-2 value represents a degree of surface unevenness and a larger SF-2 value means that the surface shape of the toner particles are not smoother, thus making the surface unevenness noticeable.

Incidentally, in the above-described Embodiments 1–3, the polarities of the N and S poles of the magnets contained in the first and second developing sleeves may be interchanged within the scope of the present invention. Further, the arrangement and species of the magnetic particles are not restricted to those used in Embodiments 1–3 unless otherwise noted.

Further, the developing apparatus of the present invention is applicable to not only the developing step wherein the rotation directions of the developing apparatus and the photosensitive drum are designed to cause downward movement of the developing portion in a vertical direction as shown in FIGS. 2 and 5, but also a developing step wherein those are designed to cause upward movement of the developing portion in a vertical direction. Similarly, the developing apparatus of the present invention is also applicable to a system using a developer container wherein an inner space is not divided into the developing chamber and the stirring chamber.

Figure 6:
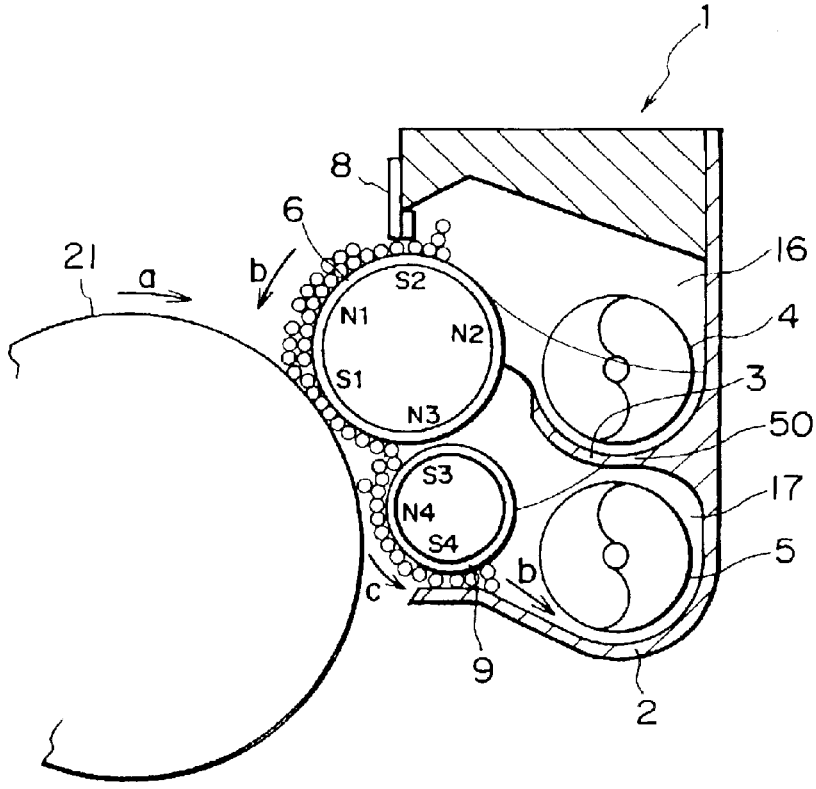
Figure 7:
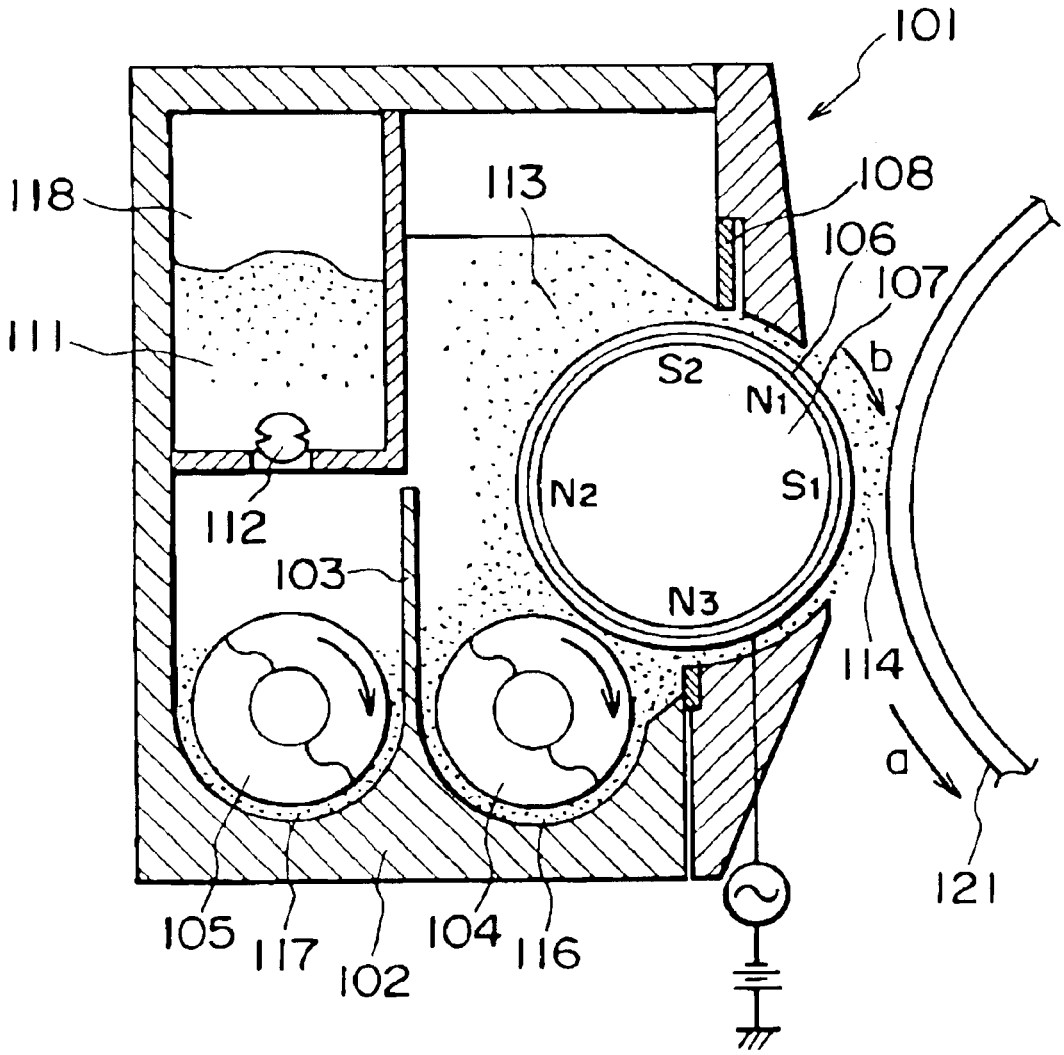
FIG. 7 PRIOR ART
FIG. 7 is a schematic sectional view showing an embodiment of a conventional display apparatus.

The developing apparatus of the present invention may particularly preferably employ a developer container as shown in FIG. 6 wherein the developing chamber and the stirring chamber are vertically disposed.

More specifically, FIG. 6 is a sectional view showing the developing apparatus using the developer container comprising the vertically disposed developing and stirring chambers. Reference numerals identical to those in FIGS. 1–5 represent members identical to those in the figures, and description thereto is omitted.

In this embodiment (FIG. 6), a recycling mechanism of the developer is different from those in Embodiments 1–3. More specifically, when the developer after development is drawn from the second developing sleeve 9 to the stirring chamber 17, the developer is carried under stirring by the screw 5 in a longitudinal direction and is drawn into the developing chamber 16 through a communicating opening 50 disposed in the vicinity of an end portion of the partition wall 3 in its longitudinal direction. Thereafter, the developer is supplied to the first developing sleeve 6 while being carried by the screw 4 in the longitudinal direction.

As a result, by using such a developer container2 designed above, it is possible to prevent such a phenomenon that the developer on the first and second developing sleeves 6 and 9 remains thereon without being detached from the developing sleeves 6 and 9. Further, only the developer stirred in the stirring chamber 17 is carried to the developing chamber 16, thus completely suppressing the density lowering problem which may arise in the developing apparatus shown in FIGS. 1 and 2.

[Effect of the Invention]

As described hereinabove, according to the above-mentioned respective embodiments, the following effects are achieved.

It is not necessary to use the layer thickness regulating member for the second developer carrying member. Accordingly, the second developer carrying member is not contaminated with a wax component even when a toner containing the wax component is used. As a result, even if developing failure is caused due to the wa contamination occurring on the surface of the first developer carrying member, it becomes possible to compensate for the developing failure with the developing steep using the second developer carrying member. Consequently, it is possible to obtain a high-quality image.

What is claimed is:

1. A developing apparatus for developing a latent image on an image bearing member with a toner, comprising:

a developer container containing a magnetic developer including a toner containing a wax;

a first developer carrying member rotatably provided in said developer container for carrying the magnetic developer to a first developing portion;

a first magnet member fixedly disposed within said first developer carrying member, said first magnetic member having a plurality of magnetic poles comprising at least a first magnetic pole and a second magnetic pole;

a regulation member for regulating a thickness of a layer of the magnetic developer carried on said first developer carrying member;

a second developer carrying member, which is rotatable in an identical direction to said first developer carrying member, provided in said developer container on a side downstream from said first developer carrying member in a movement direction of the image bearing member so as to receive the magnetic developer from said first developer carrying member and carry the magnetic developer to a second developing portion; and a second magnet member fixedly disposed within said second developer carrying member, said second magnet member having a plurality of poles comprising at least a third magnetic pole and a fourth magnetic pole, wherein said first magnetic pole is disposed opposite to said second developer carrying member, and said second magnetic pole, which is a subsequent pole of said first magnetic pole, is disposed downstream from said first magnetic pole in a rotation direction of said first developer carrying member and has a polarity identical to a polarity of said first magnetic pole, wherein said third magnetic pole is disposed opposite to said first developer carrying member and has a polarity opposite to the polarity of said first magnetic pole, and wherein said third magnetic pole and said fourth magnetic pole generate a repulsive magnetic field on a developer container side at a peripheral surface of said second developer carrying member.

2. An apparatus according to claim 1, wherein said fourth magnetic pole is a subsequent magnetic pole disposed upstream from said third magnetic pole in a rotation direction of said second developer carrying member and has a polarity polarity identical to the polarity of said third magnetic pole.

3. An apparatus according to claim 1, wherein said developer container comprises a first chamber provided with said first developer carrying member, a second chamber disposed below said first chamber and provided with said second developer carrying member, and a communicating portion for carrying a developer peeled off said second developer carrying member from said second chamber to said first chamber.

4. A developing apparatus for developing a latent image on an image bearing member with a toner, comprising:

a developer container containing a magnetic developer comprising a toner containing a wax;

a first developer carrying member rotatably provided in said developer container for carrying the magnetic developer to a first developing portion;

a first magnet fixedly disposed within said first developer carrying member, said first magnet member having a plurality of magnetic poles comprising at least a first magnetic pole;

a regulation member for regulating a thickness of a layer of the magnetic developer carried on said first developer carrying member;

a second developer carrying member rotatable in an identical direction to said first developer carrying member, provided in said developer container on a side downstream from said first developer carrying member in a movement direction of the image bearing member so as to receive the magnetic developer from said first developer carrying member and carry the magnetic developer to a second developing portion; and a second magnet fixedly disposed within said second developer carrying member, said second magnet member having a plurality of poles comprising at least a second magnetic pole, wherein said first magnetic pole is disposed opposite to said second developer carrying member, wherein said second magnet pole is disposed opposite to said first developer carrying member and has a polarity opposite to a polarity of said first magnetic pole, and wherein said first and second developer carrying members have a surface roughness satisfying:

$0.05 \leqq Rz/Sm \leqq 0.25$, $4\ \mu m \leqq Rz \leqq 30\ \mu m$, and $20\ \mu m \leqq Sm \leqq 120\ \mu m$, where Rz represents a ten-point average roughness and Sm represents an average interval between adjacent two peaks.

5. An apparatus according to claim 4, wherein said first magnet member has a third magnetic pole, which is a subsequent magnetic pole disposed downstream from said first magnetic pole in a rotation direction of said first developer carrying member and has a polarity identical to the polarity of said first magnetic pole.

6. An apparatus according to claim 5, wherein said second magnet member has two magnetic poles, which form a repulsive magnetic field on a developer container side.

7. An apparatus according to claim 6, wherein the two magnetic poles are said second magnetic pole and a fourth magnetic pole, which is a subsequent magnetic pole disposed upstream from said second magnetic pole in a rotation direction of said second developer carrying member and has a polarity identical to the polarity of said second magnetic pole.

8. An apparatus according to claim 6, wherein said developer container comprises a first chamber provided with said first developer carrying member, a second chamber disposed below said first chamber and provided with said second developer carrying member, and a communicating portion for carrying a developer peeled off said second developer carrying member from said second chamber to said first chamber.

9. An apparatus according to any one of claims 1 and 2 through 8, wherein the toner contains the wax in an amount of 1–20 wt. %.

10. An apparatus according to any one and of claims 1 and 1 through 8, wherein the toner is prepared by kneading at least a binder resin and the wax and then pulverizing a resultant kneaded product.

11. An apparatus according to any one of claims 1 and 2 through 8, wherein the developer comprises a nonmagnetic toner and a magnetic carrier.

* * * * *

UNITED STATES PATENT AND TRADEMARK OFFICE

CERTIFICATE OF CORRECTION

PATENT NO. : 6,975,825 B2
APPLICATION NO. : 10/406458
DATED : December 13, 2005
INVENTOR(S) : Tomoyuki Sakamaki et al.

It is certified that error appears in the above-identified patent and that said Letters Patent is hereby corrected as shown below:

ON THE TITLE PAGE:

UNDER REFERENCES CITED, ITEM (56):

"JP 11-212366 8/1998" should read --JP 11-212366 8/1999--;
"JP 01-321460 12/1989" should read --JP 1-321460 12/1989--; and
"JP 09-106188 4/1997" should read --JP 9-106188 4/1997--.

IN THE ABSTRACT, ITEM (57):

Line 10, "dispose" should read --disposed--; and
Line 15, "is disposed" should read --disposed--.

COLUMN 1:

Line 43, "caused to the magnetic" should read --.

COLUMN 2:

Line 11, "through" should read --extend through--;
Line 26, "blade (108" should read --blade 108--; and
Line 53, "meting-tyoe" should read --melting-type--.

COLUMN 3:

Line 6, "becomes better one." should read --improves.--;
Line 13, "trend" should read --tendency--;
Line 41, "adjacent two" should read --two adjacent--; and
Line 54, "migrate" should read --migrates--.

COLUMN 4:

Line 28, "preferred" should read --preferably--.

COLUMN 5:

Line 9, "adjacent two" should read --two adjacent--; and
Line 51, "21*d*; the" should read --21*d* the--.

UNITED STATES PATENT AND TRADEMARK OFFICE

CERTIFICATE OF CORRECTION

PATENT NO. : 6,975,825 B2
APPLICATION NO. : 10/406458
DATED : December 13, 2005
INVENTOR(S) : Tomoyuki Sakamaki et al.

It is certified that error appears in the above-identified patent and that said Letters Patent is hereby corrected as shown below:

COLUMN 6:

Line 1, “chargers,” should read --chargers--.

COLUMN 7:

Line 5, “migrate” should read --migrates--; and
Line 46, “developing” should read --the developing--.

COLUMN 9:

Line 46, “be lead” should read --be led--.

COLUMN 10:

Line 31, “the. N2” should read --the N2--;
Line 33, “devel-“ should read --the devel- --; and
Line 61, “little causing the” should read --causing little--.

COLUMN 11:

Line 2, “The” should read --When the--;
Line 4, “is filled” should read --are filled--; and “up),” should read --up,--;
Line 6, “after” should read --after being--;
Line 53, “particle” should read --particles--;
Line 56, “catched” should read --caught--; and
Line 60, “rom” should read --from--

COLUMN 12:

Line 2, “irregular-“ should read --irregular--;
Line 22, “met-“ should be deleted;
Line 31, “catched’ should read --caught--;
Line 35, “smooth” should read --excessively smooth,--;
Line 36, “excessively,” should be deleted; and
Line 44, “too strong” should read --strong enough--.

UNITED STATES PATENT AND TRADEMARK OFFICE

CERTIFICATE OF CORRECTION

PATENT NO. : 6,975,825 B2
APPLICATION NO. : 10/406458
DATED : December 13, 2005
INVENTOR(S) : Tomoyuki Sakamaki et al.

It is certified that error appears in the above-identified patent and that said Letters Patent is hereby corrected as shown below:

COLUMN 13:

Line 3, “internal” should read --interval--;
Line 11, “adjacent two” should read --two adjacent--;
Line 16, “S2, S2,” should read --S2, S3,--;
Line 17, “within a” (first occurrence) should be deleted; and
Line 34, “adjacent two” should read --two adjacent--.

COLUMN 14:

Line 8, “he toner” should read --the toner--;
Line 23, “less” should read --smaller--;
Line 54, “less” should be deleted;
Line 55, “cause image” should read --cause less image; and “such a a” should read --such as a--; and
Line 63, “available from microscope (“FE-SEM (S-800)”,” should be deleted.

COLUMN 15:

Line 1, “an Sf-2.” should read --and Sf-2.--; and
Line 50, “container2” should read --container 2--.

COLUMN 16:

Line 1, “wa contamination” should read --wax contamination--;
Line 4, “steep” should read --step--.

COLUMN 17:

Line 4, “magnet” should read --magnet number--; and
Line 19, “magnet” should read --magnet number--.

UNITED STATES PATENT AND TRADEMARK OFFICE

CERTIFICATE OF CORRECTION

PATENT NO. : 6,975,825 B2
APPLICATION NO. : 10/406458
DATED : December 13, 2005
INVENTOR(S) : Tomoyuki Sakamaki et al.

It is certified that error appears in the above-identified patent and that said Letters Patent is hereby corrected as shown below:

COLUMN 18:

Line 29, "one and" should read --one--; and
Line 30, "1 through" should read --2 through--.

Signed and Sealed this

Eighth Day of August, 2006

JON W. DUDAS
*Director of the United States Patent and Trademark Office*